US007686591B2

(12) United States Patent
Baron et al.

(10) Patent No.: US 7,686,591 B2
(45) **Date of Patent: *Mar. 30, 2010**

(54) SUPPORT STRUCTURE FOR A PORTABLE AIR COMPRESSOR

(75) Inventors: Michael P. Baron, Phoenix, MD (US); Mark Downes, Bel Air, MD (US); John E. Buck, Cockeysville, MD (US)

(73) Assignee: Black & Decker Inc., Newark, DE (US)

( * ) Notice: Subject to any disclaimer, the term of this patent is extended or adjusted under 35 U.S.C. 154(b) by 1068 days.

This patent is subject to a terminal disclaimer.

(21) Appl. No.: 11/355,377

(22) Filed: Feb. 16, 2006

(65) Prior Publication Data

US 2006/0140784 A1 Jun. 29, 2006

Related U.S. Application Data

(63) Continuation of application No. 10/392,567, filed on Mar. 20, 2003, now Pat. No. 7,029,240.

(51) Int. Cl.
*F04B 53/00* (2006.01)

(52) U.S. Cl. ..... 417/234

(58) Field of Classification Search ..... 417/234; 137/343, 899

See application file for complete search history.

(56) References Cited

U.S. PATENT DOCUMENTS

| | | | | |
|---|---|---|---|---|
| 1,756,806 | A * | 4/1930 | Beach | 137/899.4 |
| 2,074,293 | A * | 3/1937 | Wohlmeyer | 137/899.4 |
| D140,642 | S | 3/1945 | Mandt et al. | |
| D144,482 | S | 4/1946 | Davis et al. | |
| 2,434,675 | A | 1/1948 | Simpson | |
| 2,490,305 | A | 12/1949 | Jones | |
| 2,521,313 | A | 9/1950 | Sproat | |
| D170,330 | S | 9/1953 | Miller | |
| 2,685,404 | A | 8/1954 | Wohlmeyer | |
| 2,772,921 | A | 12/1956 | Nance | |
| 2,804,259 | A | 8/1957 | Ralston | |
| 2,812,895 | A | 11/1957 | Peeps | |
| 2,826,354 | A | 3/1958 | Field | |
| D185,000 | S | 4/1959 | Hoover | |

(Continued)

FOREIGN PATENT DOCUMENTS

| | | |
|---|---|---|
| DE | 903 023 C | 2/1954 |

(Continued)

*Primary Examiner*—Charles G Freay
(74) *Attorney, Agent, or Firm*—Harness, Dickey & Pierce, P.L.C.

(57) ABSTRACT

A portable air compressor assembly includes a tubular frame having a pair of parallelogram shaped side sections. A support plate is connected between the side sections and horizontally positioned in a compressor normal operating position. A plurality of operating components connect to the support plate. A fluid pressure tank is supported perpendicular to the side sections and forward of the operating components. The frame envelopes the operating components' outer perimeter and angularly extends to a stop point rearward of the operating components. When tipped rearward to the stop point, the compressor assembly returns by gravity to the compressor normal operating position. An instrument and connector panel including an engine on/off switch is mounted in a protected position. Wheels and structural feet are removable and a handle is retractable and removable for shipping.

7 Claims, 11 Drawing Sheets

U.S. PATENT DOCUMENTS

| | | | | | |
|---|---|---|---|---|---|
| D197,860 | S | | 3/1964 | Winger | |
| 3,284,096 | A | | 11/1966 | Hansen et al. | |
| 3,433,415 | A | | 3/1969 | Enssle | |
| 3,591,196 | A | * | 7/1971 | Ott | 280/1.195 |
| D223,039 | S | | 2/1972 | Widmer | |
| D231,226 | S | | 4/1974 | Monroe | |
| D243,282 | S | | 2/1977 | Burenga | |
| 4,077,747 | A | | 3/1978 | Burenga | |
| 4,089,655 | A | | 5/1978 | Raiete | |
| D249,265 | S | | 9/1978 | Nanjo | |
| 4,132,088 | A | | 1/1979 | Grosskopf | |
| D273,011 | S | | 3/1984 | Dudley | |
| D273,493 | S | | 4/1984 | Vitaloni | |
| D278,425 | S | | 4/1985 | Toshihiko | |
| D293,446 | S | | 12/1987 | Morgan | |
| D293,584 | S | | 1/1988 | Morgan | |
| D293,585 | S | | 1/1988 | Morgan | |
| 4,722,673 | A | | 2/1988 | Grime et al. | |
| 5,116,207 | A | | 5/1992 | Doolittle et al. | |
| 5,181,840 | A | | 1/1993 | Zecchini | |
| 5,217,238 | A | * | 6/1993 | Cyphers et al. | 280/47.18 |
| D352,292 | S | | 11/1994 | Morgan | |
| D352,293 | S | | 11/1994 | Morgan | |
| D352,294 | S | | 11/1994 | Morgan | |
| 5,378,119 | A | | 1/1995 | Goertzen | |
| 5,419,497 | A | | 5/1995 | Warrington | |
| 5,538,402 | A | * | 7/1996 | McKenney | 417/234 |
| 5,931,207 | A | | 8/1999 | Gianino | |
| 6,004,103 | A | | 12/1999 | Fisher et al. | |
| D423,518 | S | | 4/2000 | Milligan et al. | |
| 6,210,132 | B1 | | 4/2001 | Shiinoki et al. | |
| D445,115 | S | | 7/2001 | Hutchinson et al. | |
| D449,311 | S | | 10/2001 | Graber et al. | |
| D450,061 | S | | 11/2001 | Graber et al. | |
| D454,357 | S | | 3/2002 | Diels | |
| 6,364,632 | B1 | | 4/2002 | Cromm et al. | |
| 6,375,437 | B1 | | 4/2002 | Nolan | |
| 6,406,270 | B1 | | 6/2002 | Kopel | |
| 6,431,839 | B2 | | 8/2002 | Gruber et al. | |
| 6,447,257 | B2 | | 9/2002 | Orschell | |
| 6,468,048 | B1 | | 10/2002 | Burkholder et al. | |
| 6,582,201 | B2 | | 6/2003 | Lucchi | |
| 6,773,237 | B2 | | 8/2004 | Burford et al. | |
| 7,029,240 | B2 | * | 4/2006 | Baron et al. | 417/234 |
| 2002/0131872 | A1 | | 9/2002 | Lucchi | |
| 2003/0180156 | A1 | | 9/2003 | Brashears et al. | |
| 2004/0028535 | A1 | | 2/2004 | Brashears et al. | |

FOREIGN PATENT DOCUMENTS

| | | | |
|---|---|---|---|
| DE | 8100434 | U1 | 7/1981 |
| DE | 197 08 191 | A1 | 1/1998 |

* cited by examiner

SUPPORT STRUCTURE FOR A PORTABLE AIR COMPRESSOR

This application is a continuation of U.S. patent application Ser. No. 10/392,567 filed on Mar. 20, 2003 and entitled "Support Structure for a Portable Air Compressor" which claimed priority under 35 U.S.C. §119(e) to U.S. Provisional Application No. 60/417,725 filed on Oct. 10, 2002. The disclosure of the above applications are incorporated herein by reference.

FIELD OF THE INVENTION

The present invention relates in general to air compressors and more specifically to a support structure for a portable air compressor.

BACKGROUND OF THE INVENTION

Air compressors normally provide a source of pressurized air which is temporarily stored in a pressure tank. A motivating means, typically an electric motor or a combustion engine, is connected to a compressor unit. The compressor unit typically includes a piston assembly, or compressor pump, which compresses air from the atmosphere and forces it into the fluid pressure tank for temporary storage. To make air compressors portable for job site use, structural frames are provided. The frames normally provide at least one wheel for mobility of the air compressor assembly.

Several drawbacks exist for common portable air compressor assemblies. The first drawback is that the component parts of the air compressor assembly, typically items that include the muffler from a gasoline engine and the air filter for the engine, and the cooling head for the compressor, are often arranged outside of the structural envelope of the frame supporting the air compressor assembly. Other smaller items such as the bleed and drain valve for the fluid pressure tank, the individual gages used to determine the pressure of the system, and drain ports from the various operating components are also frequently exposed (i.e., extending outside of an envelope of the frame). Exposed components are susceptible to damage.

Another disadvantage of known portable air compressor assemblies is the tendency of the assembly to tip over when pushed or pulled by the handle. Wheels used to support and provide for movement of the frame also allow the entire assembly to rotate and flip over. When an air compressor assembly flips over, damage to those items which extend beyond the perimeter of the frame can occur and fuel spillage can also occur.

It is therefore desirable to provide a portable air compressor assembly which overcomes the drawbacks of known air compressor assemblies.

SUMMARY OF THE INVENTION

In one preferred embodiment of the present invention, a portable air compressor assembly includes a frame having a pair of parallel side sections. A support plate is horizontally connected between the side sections in a compressor normal operating position. A plurality of operating components connect to the support plate. A fluid pressure tank is supported perpendicular to the side sections and forward of the operating components. The frame side sections envelope an outer perimeter of the operating components and angularly extend to a frame rotation stop point rearward of the operating components. When tipped rearward to the frame rotation stop point, the compressor assembly returns by gravity to the compressor normal operating position.

In another preferred embodiment, a support structure for a portable air compressor includes a frame having a pair of approximately parallel side sections and a support plate horizontally disposed between the side sections. A plurality of components are connected to the support plate including an engine, a compressor and a fluid pressure tank. An axle is slidably disposed through a lower tubular portion of both side sections, the axle having distal ends operably forming opposed outer planar envelopes of the portable air compressor. An instrument support panel is connectably disposed on the frame and positioned adjacent to a select one of the outer planar envelopes. A plurality of instruments including an engine on/off switch, at least one pressure gage, at least one quick-disconnect fitting and at least one unloader valve are each mounted on the instrument support panel such that each of the instruments and the instrument support plate are completely disposed within one of the selected outer planar envelopes.

Wheels, rotatably supported on the axle, and structural feet are used to support the assembly and are each removable for shipping. A center-of-gravity for the assembly is positioned forward of the wheels such that when the assembly tips rearward, the center-of-gravity remains forward of a vertical axis taken through the axle, biasing the assembly to return to a normal operating position by gravity. In another preferred embodiment, the side sections provide dual lift handles for the assembly. In still another preferred embodiment, a centrally positioned handle is retractable or removable for shipping.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
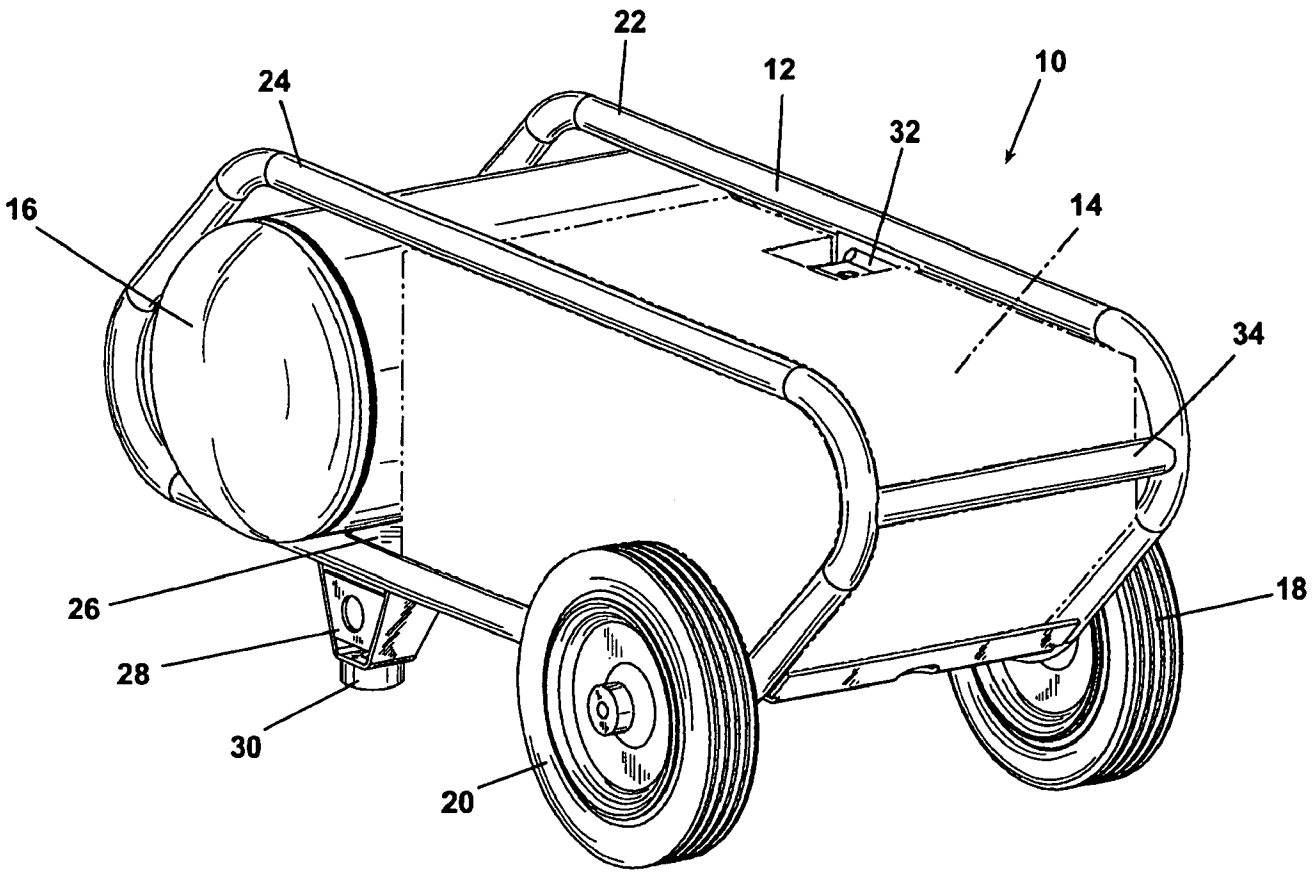
FIG. 1 is a perspective view of a preferred embodiment for an air compressor assembly of the present invention.

FIG. 1 shows an air compressor assembly 10 according to a preferred embodiment of the present invention. The air compressor assembly 10 includes a frame 12, a component group 14, and a fluid pressure tank 16. A first wheel 18 and a second wheel 20 are rotatably supported from the frame 12 at an aft end of the air compressor assembly 10. The frame 12 includes a first side 22 and a second side 24. The first side 22 and the second side 24 are generally tubular shaped frame members generally formed in a parallelogram configuration having rounded corners. A support plate 26 is provided at a lower portion of the frame 12 and is mechanically joined to the first side 22 and the second side 24, respectively. A pair of support feet 28 (only one is visible in this view) are mechanically joined to a forward end of the frame 12 at an under surface of the support plate 26 as described in better detail in reference to FIG. 9.

Each of the support feet 28 includes an elastomeric pad 30. The purpose of the elastomeric pad 30 is to reduce the sliding motion of the air compressor assembly 10 when the engine is operating and to prevent the unit from sliding when placed on a relatively smooth surface. A control panel 32 is provided on either the first side 22 or the second side 24. In the embodiment shown, the control panel 32 is supported by an upper horizontal and a lower horizontal member of the first side 22. The control panel 32 is further described in reference to FIG. 3. A rear support member 34 is provided to structurally join the first side 22 to the second side 24. The rear support member 34 also serves as a portion of a frame rotation stop point where the frame 12 contacts the ground surface as described in better detail in reference to FIG. 5. In a preferred embodiment, the rear support member 34 and the support plate 26 are each welded to the first side 22 and the second side 24.

Figure 2:
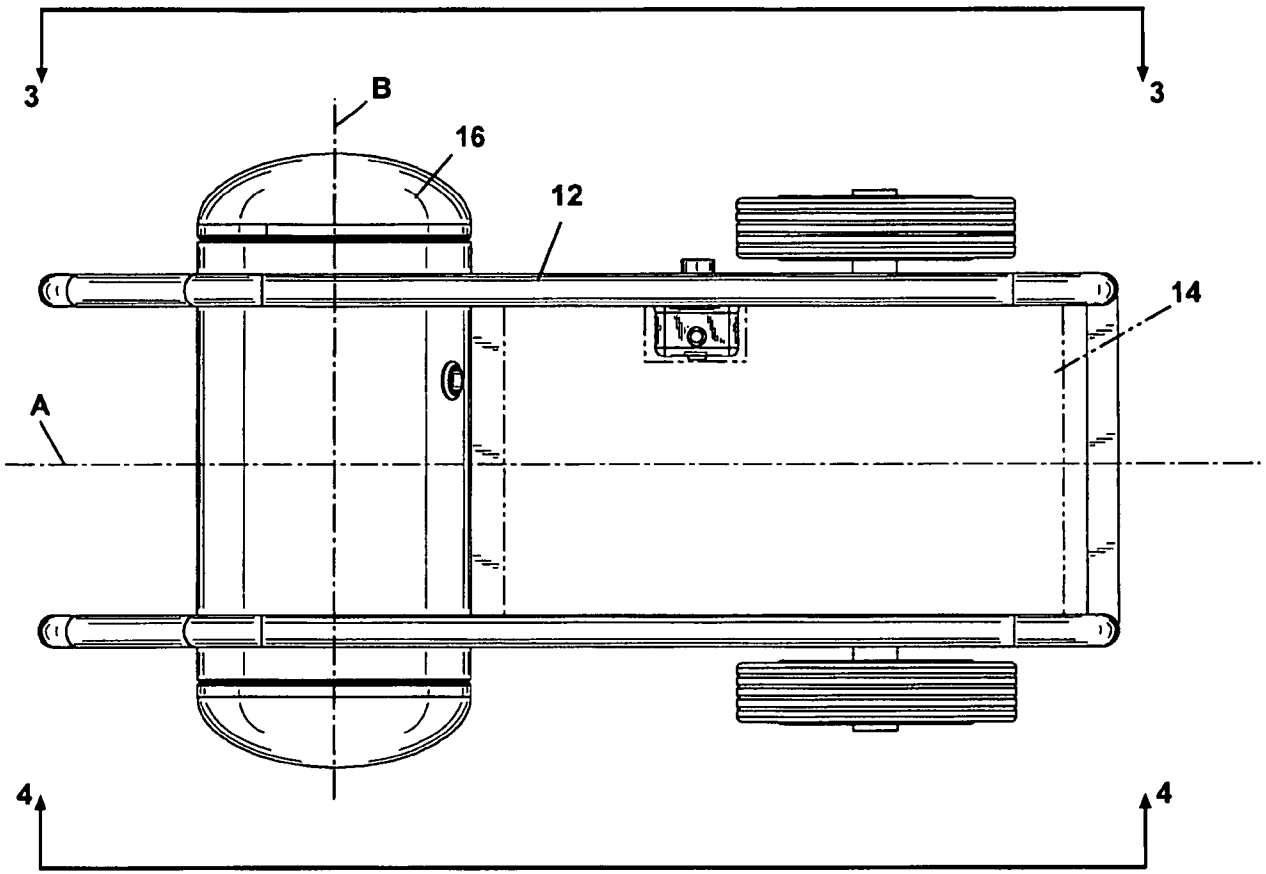
FIG. 2 is a plan view of the assembly of FIG. 1 identifying the fluid storage tank orientation relative to the longitudinal axis of the assembly.

As shown in FIG. 2, the frame 12 is configured such that the component group 14 is totally enclosed within an envelope of the frame 12. An assembly longitudinal axis A is shown bisecting the frame 12. The fluid pressure tank 16 includes a tank longitudinal axis B positioned approximately perpendicular to the assembly longitudinal axis A.

Figure 3:
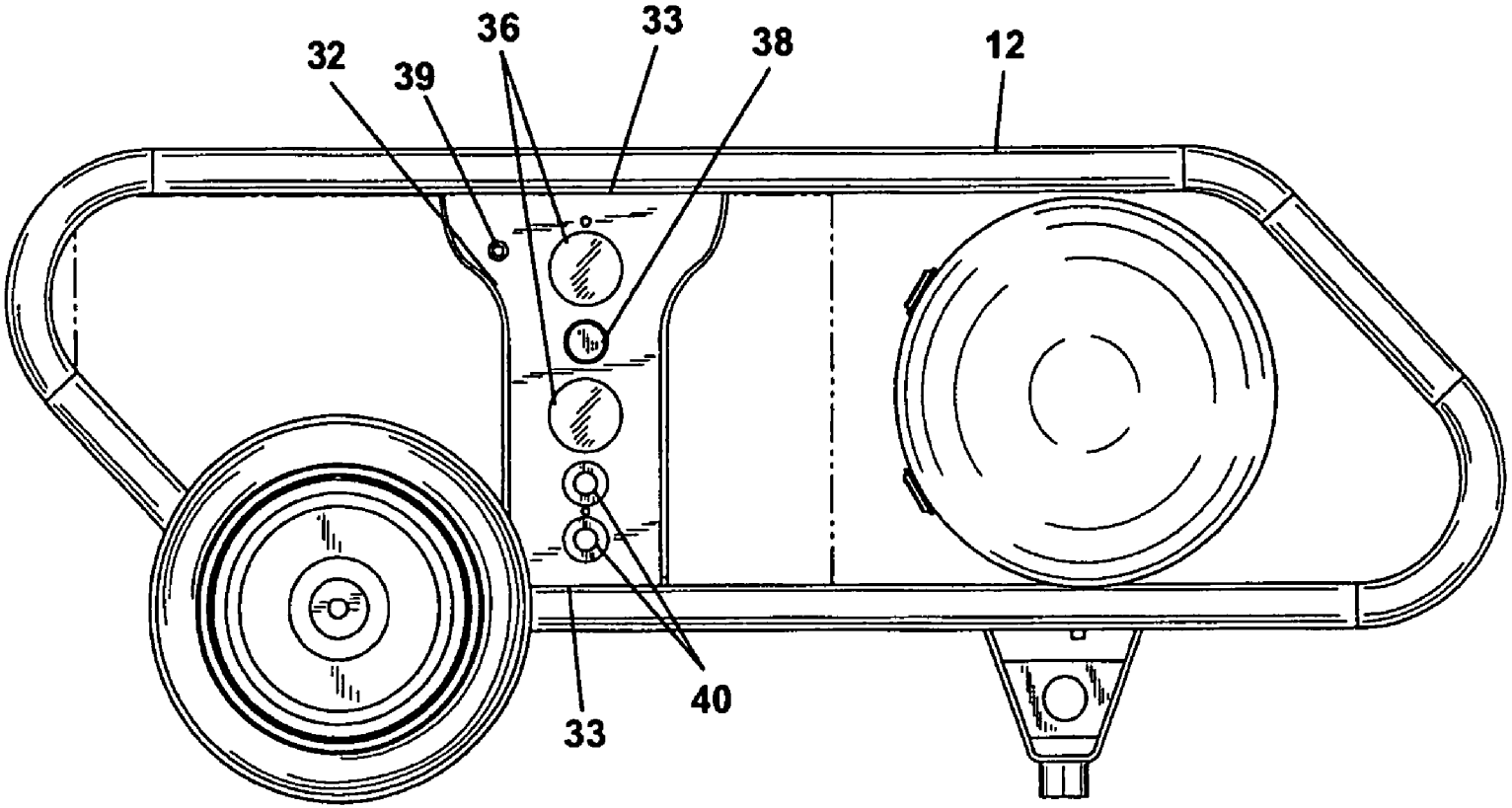
FIG. 3 is a side elevation view taken along Section 3 of FIG. 2 showing a control panel mounted to the frame structure.

As best seen in FIG. 3, the control panel 32 is supported at both an upper and lower extremity to the frame 12. In a preferred embodiment, the control panel 32 is mechanically fastened (e.g., welded) at joints 33 to the frame 12. The control panel 32 is shown in FIG. 3 in a generally vertical orientation, however, the control panel 32 can also be supported along a major side using a mechanically fastened joint similar to joint 33 to either an upper horizontal or a lower horizontal portion of the frame 12. A plurality of components are mounted on the control panel 32. In particular, the control panel includes at least one pressure gage 36, an air regulator adjustment knob 37, an unloader valve 38, an engine on/off switch 39, and a pair of quick disconnect fittings 40. The arrangement of components on the control panel 32 is exemplary of a plurality of configurations of the pressure gages 36, the unloader valve 38, the on/off switch 39, and the quick disconnect fittings 40 that are possible.

Figure 4:
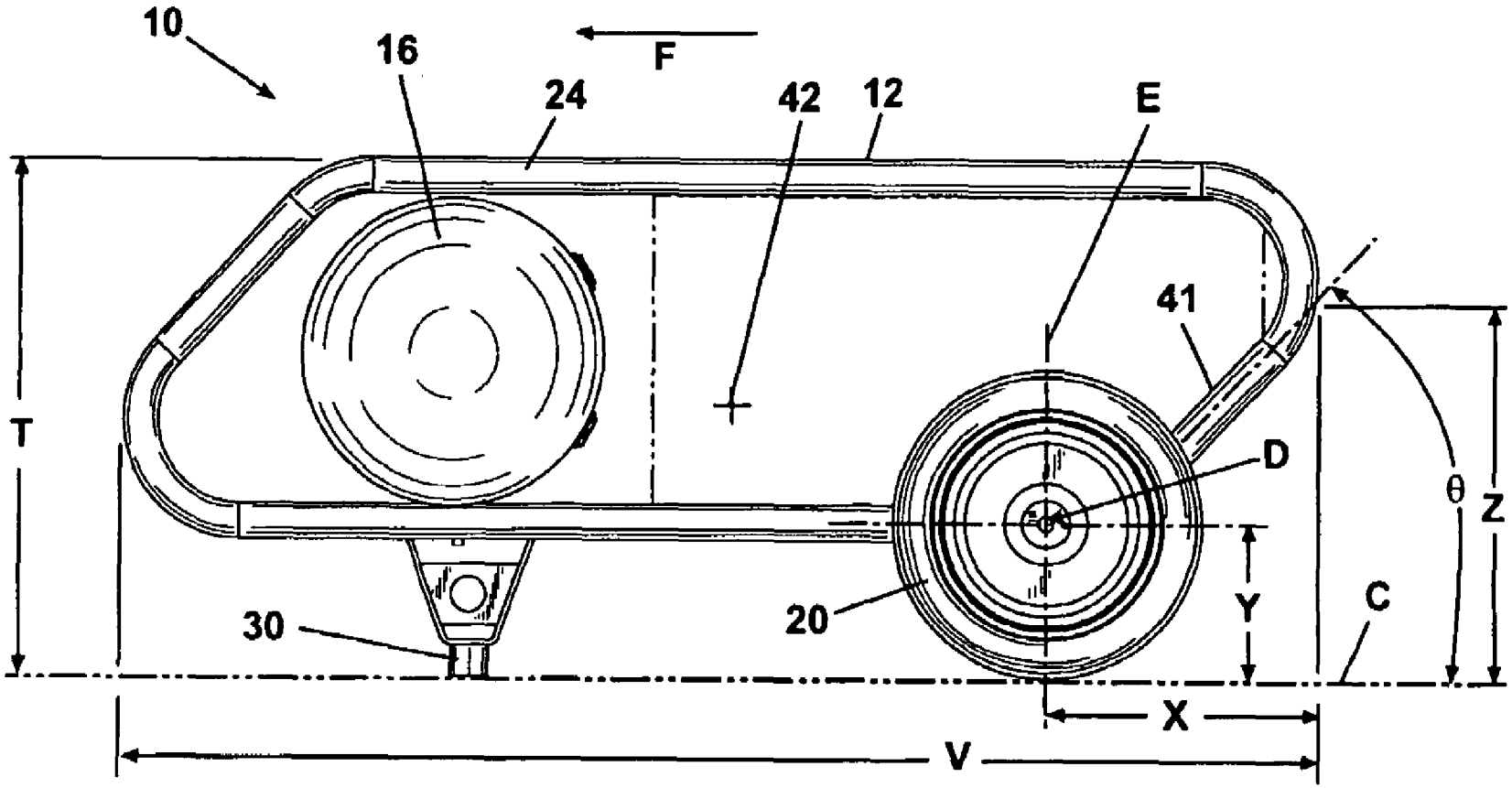
FIG. 4 is a side elevation view taken along Section 4 of FIG. 2 identifying the relationship between the wheels and supporting feet of the present invention, and a center-of-gravity for the assembly.

As detailed in FIG. 4, a rear tubular member 41 joins an upper horizontal to a lower horizontal tube of the frame 12 for both the first side 22 (not shown) and the second side 24. Each rear tubular member 41 forms a frame clearance angle θ from a ground surface C as shown. The frame clearance angle θ permits the air compressor assembly 10 to be rotated about an axis of rotation D formed at the center of each of the first wheel 18 (not shown) and the second wheel 20. An axle vertical axis E extends from the axis of rotation D. A center-of-gravity 42 is disposed forward of the axle vertical axis E. The position shown for the air compressor assembly 10 in FIG. 4 is the normal operating position having each of the first wheel 18 and the second wheel 20 and each of the support feet 28 contacting the ground surface C. It will be apparent to a person of skill that the ground surface C can vary in geometry from that shown such that the normal operating position can vary providing that each of the wheels and the support feet contact the ground surface C. Also as shown in FIG. 4, the second wheel 20 (as well as the first wheel 18, not shown) are positioned at a rear-most portion of the lower horizontal tube of the frame 12. The fluid pressure tank 16 is generally positioned over the support feet 28 as shown. The configuration of the frame 12 therefore provides the wheels (18, 20) and the support feet 28 adjacent to the heaviest components to adequately support the components of the air compressor assembly 10. References herein to forward and rear (and rearward) directions are in relation to the forward direction arrow F.

Figure 5:
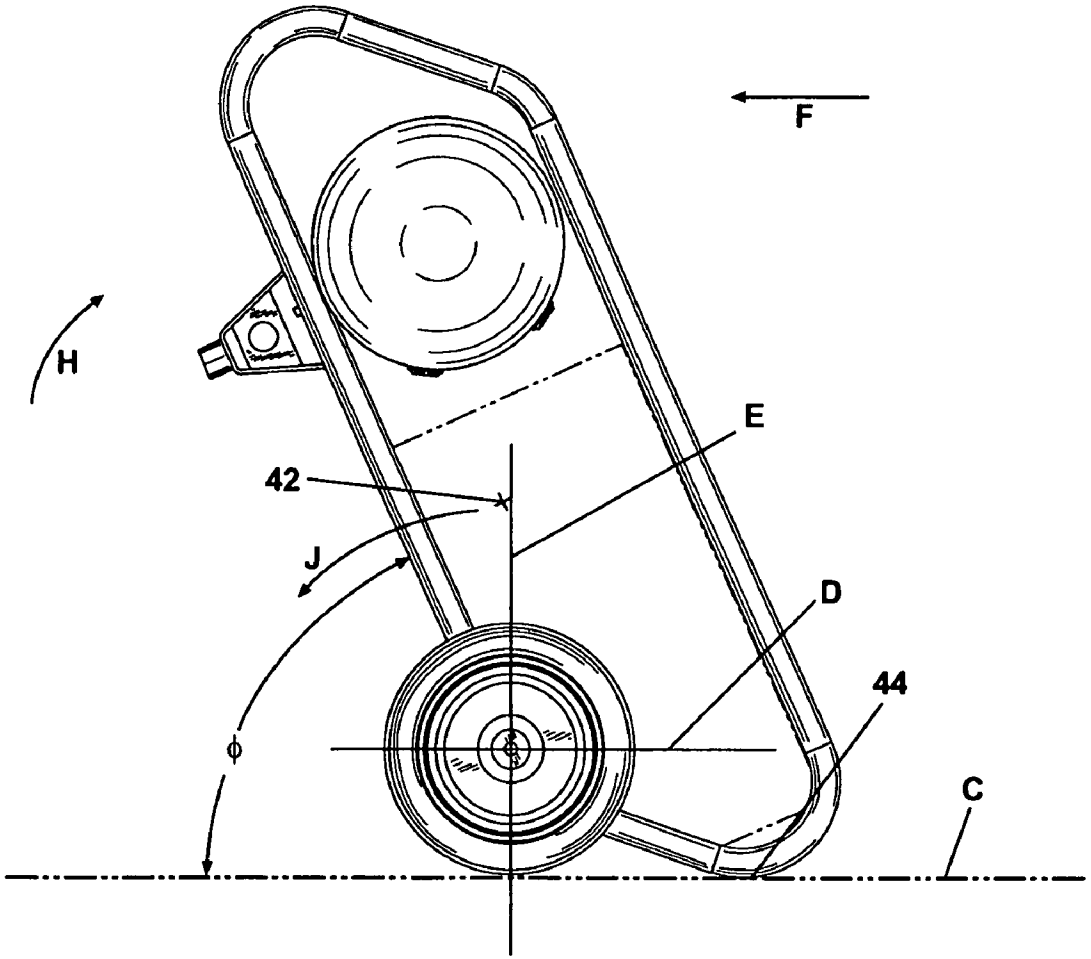
FIG. 5 is the side elevation view of FIG. 4 showing the compressor assembly rotated about the axis of the wheels to a stop position determined by an aft projecting portion of the frame.

As best seen in FIG. 5, the air compressor assembly 10 is rotated about the axis of rotation D in the lift rotation direction H, until the rear tubular member 41 and/or the rear support member 34 contact the ground surface C. A frame rotation stop point 44 is shown at the point of contact between the frame 12 and the ground surface C. At the rotated position shown in FIG. 5, the center-of-gravity 42 remains forward of the axle vertical axis E. The frame 12 in this position is rotated to an assembly rotation angle ϕ from the ground surface C. At the assembly rotation angle ϕ, gravity will bias the air compressor assembly 10 to rotate in the return rotation direction J about the axis of rotation D to return to the normal operating position shown in FIG. 4. For the condition shown in FIG. 5 having a horizontal ground surface C, the maximum assembly rotation angle ϕ will depend on several variables including (with reference to FIG. 4), the distance X between the axle vertical axis E and a rearward facing end of the frame 12, a radius of the wheels Y, and the height Z from the ground surface C to the frame rotation stop point 44.

Referring back to FIG. 4, a total height T and a total length V for the air compressor assembly 10 are shown. In a preferred embodiment, the total height T is approximately 51 cm (20"), and the total length V is approximately 119 cm (47"). It will be the obvious that the dimensions of the present invention can be varied without departing from the spirit and scope of the present invention.

Figure 6:
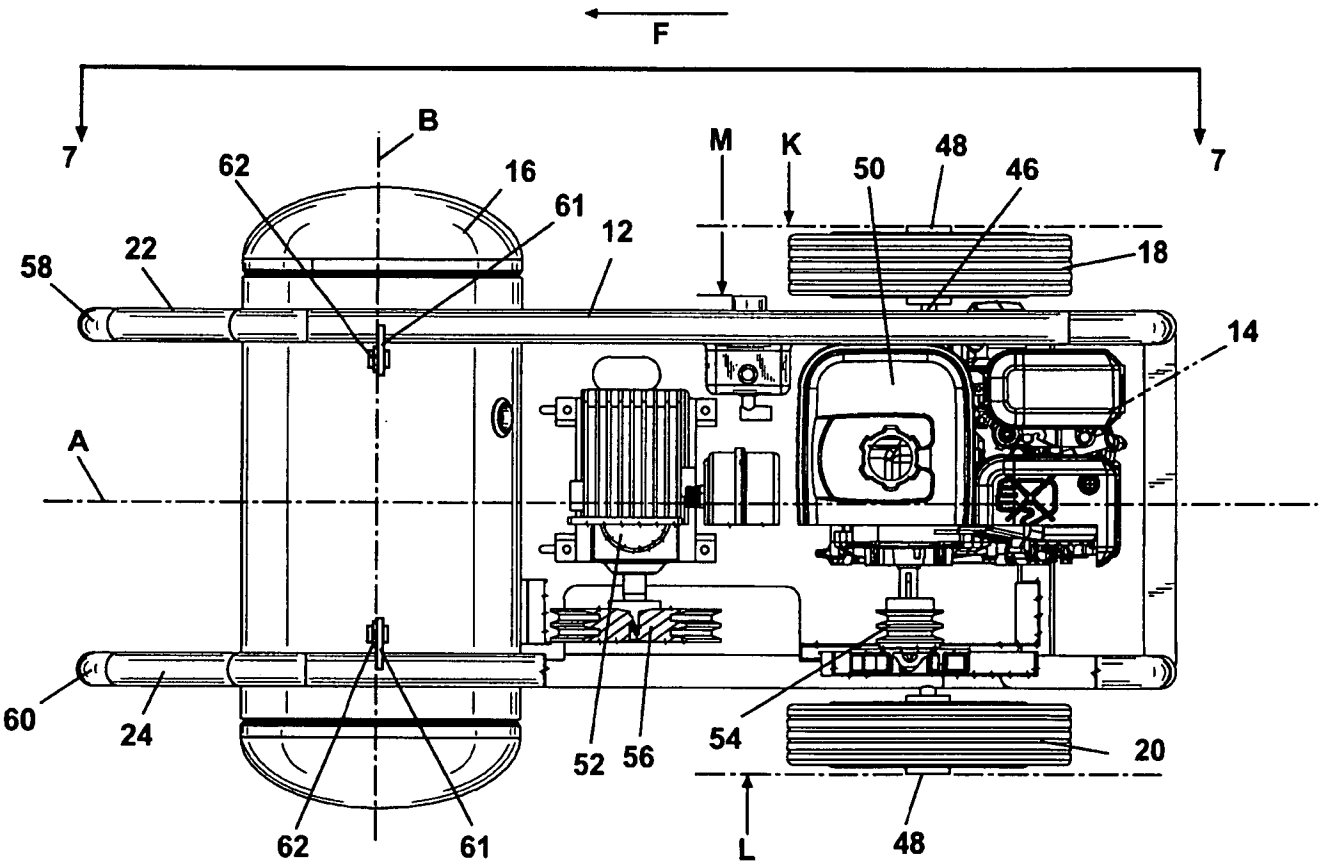
FIG. 6 is a plan view showing an exemplary engine and compressor mounted on the support plate between the two side sections.

As best detailed in FIG. 6, a gasoline powered reciprocating engine 50 and a compressor pump 52 are shown. The engine 50 includes a drive pulley 54 coupled by a V-belt (not shown) to a rotating pulley 56 of the compressor pump 52. The arrangement of the engine 50, the compressor pump 52, and the fluid pressure tank 16 is selected to generally evenly distribute the weight of these components about the assembly longitudinal axis A. The first side 22 provides a pull/lift location 58 and the second side 24 provides a pull/lift location 60 to manually lift and move the air compressor assembly 10 from a forward end of the compressor assembly 10. The air compressor assembly 10 can be lifted from either of the pull/lift locations 58 or 60, respectively, however; to push the air compressor assembly 10 in a direction opposite to the forward direction F, it is preferable to hold both the pull/lift locations 58 and 60 simultaneously. In the embodiment shown, the fluid pressure tank 16 is partially supported from the frame 12 by a pair of brackets 61 which are mechanically connected to each of a pair of tabs 62 welded to the fluid pressure tank 16.

The axle 46 has distal ends which form each of an outer planar envelope K and an outer planar envelope L shown. The end caps 48 are included within the outer planar envelopes K and L, respectively. The frame 12 and all of the components including those mounted to the control panel 32 and bounded by the control panel outer envelope M are within the region bounded by the outer planar envelopes K and L, respectively.

Figure 7:
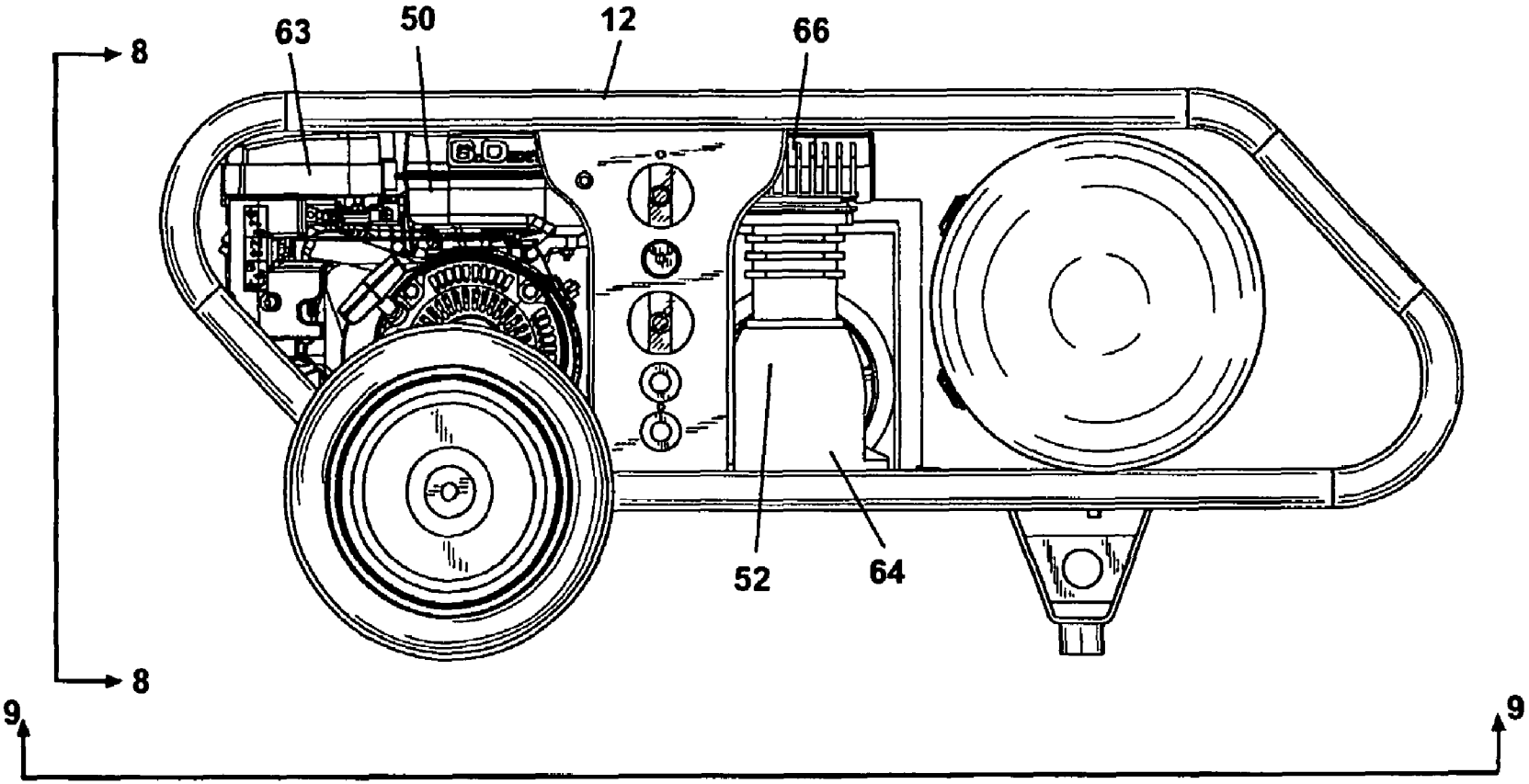
FIG. 7 is a side elevation view taken at Section 7 of FIG. 6 identifying that all components of the engine and air compressor are fully enclosed within an envelope of the frame.

As shown in FIG. 7, rear facing components of the engine 50, including a muffler 63, are positioned within the envelope of the frame 12. A compressor body 64 and a cooling head 66 of the compressor 52 also fit within the envelope of the frame 12. This arrangement reduces the potential for damage occurring to these components by extending beyond the protected boundary of the frame 12.

Figure 8:
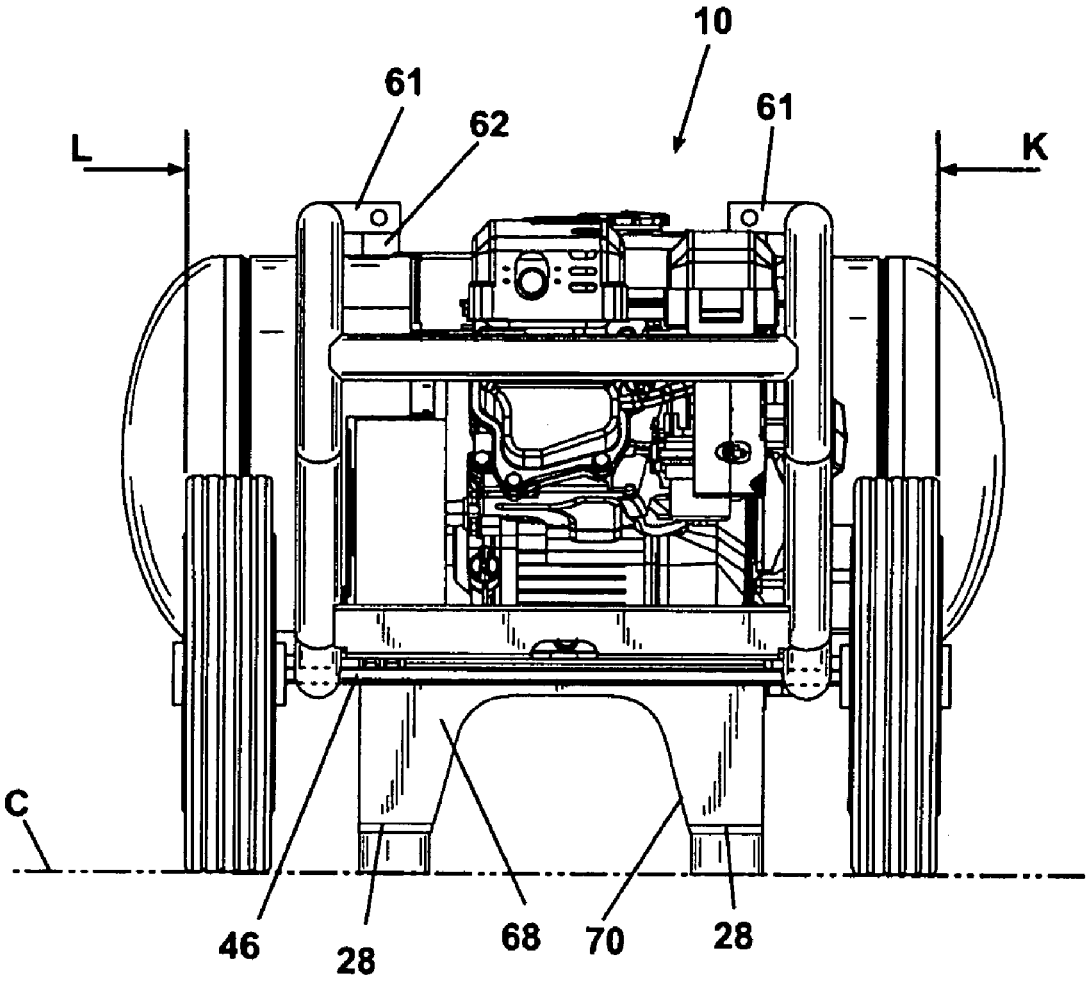
FIG. 8 is rear elevation view taken at Section 8 of FIG. 7 showing the geometry of the supporting feet and the axle rotatably penetrating the tubular members of the frame.

Referring now to FIG. 8, the brackets 61 and the tabs 62 supporting the fluid pressure tank 16 to the frame 12 are shown in greater detail. The axle 46 is rotatably positioned through apertures (not shown) formed in the lower horizontal members of the first side 22 and the second side 24 of the frame 12 approximate an aft end of the compressor assembly 10. The geometry and structure of the support feet 28 are also shown. The structure of the support feet 28 is mechanically fastened to the support plate 26 as best described in reference to FIG. 9. The support feet 28 form a portion of a support structure 68 which includes arches 70 to separate each of the support feet 28. The arches 70 allow the air compressor assembly 10 to remain stationery and each of the support feet 28 in contact with the ground surface C when the ground surface C varies from the horizontal plane shown.

Figure 9:
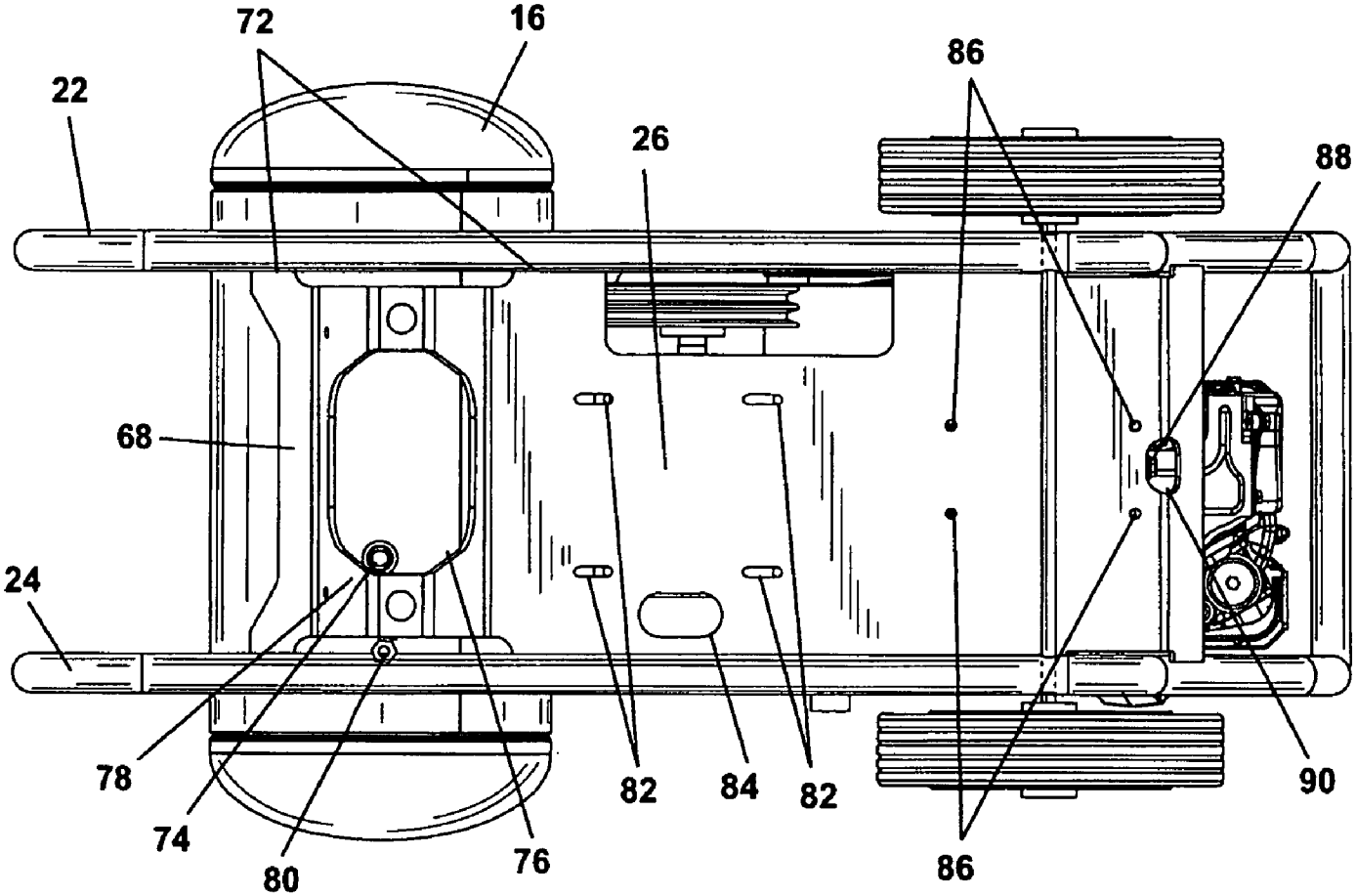
FIG. 9 is a plan view from an underside of the compressor assembly, taken at Section 9 of FIG. 7, detailing the lower support plate and the mounting fasteners used to support the equipment to the support plate.

As best shown in FIG. 9, an undersurface of the air compressor assembly 10 provides the support locations for the support plate 26 to each of the first side 22 and the second side 24, respectively. A plurality of weld joints 72 join portions of the support plate 26 to each of the first side 22 and the second side 24. A drain valve 74 for the fluid pressure tank 16 is accessible via an aperture 76 formed in the support structure 68. A raised area 78 of the support structure 68 adjacent to the drain valve 74 provides additional protection for the portion of the drain valve 74 extending below the outer circumference of the fluid pressure tank 16. The support structure 68 is mechanically connected to the fluid pressure tank 16 via a plurality of fasteners 80 and tabs (not shown). The compressor 52 (shown in FIG. 7), is mounted to the support plate 26 via a plurality of fasteners 82. A drain fitting (not shown) for the compressor 52 is aligned with a drain aperture 84 through the support plate 26 in order to drain the lubrication fluid contents of the compressor 52. The engine 50, similarly shown in FIG. 7, is mounted to the support plate 26 via a plurality of fasteners 86. A drain fitting 88 for the engine 50 has a drain aperture 90 aligned therewith to permit the lubrication fluid of the engine 50 to be drained.

Figure 10:
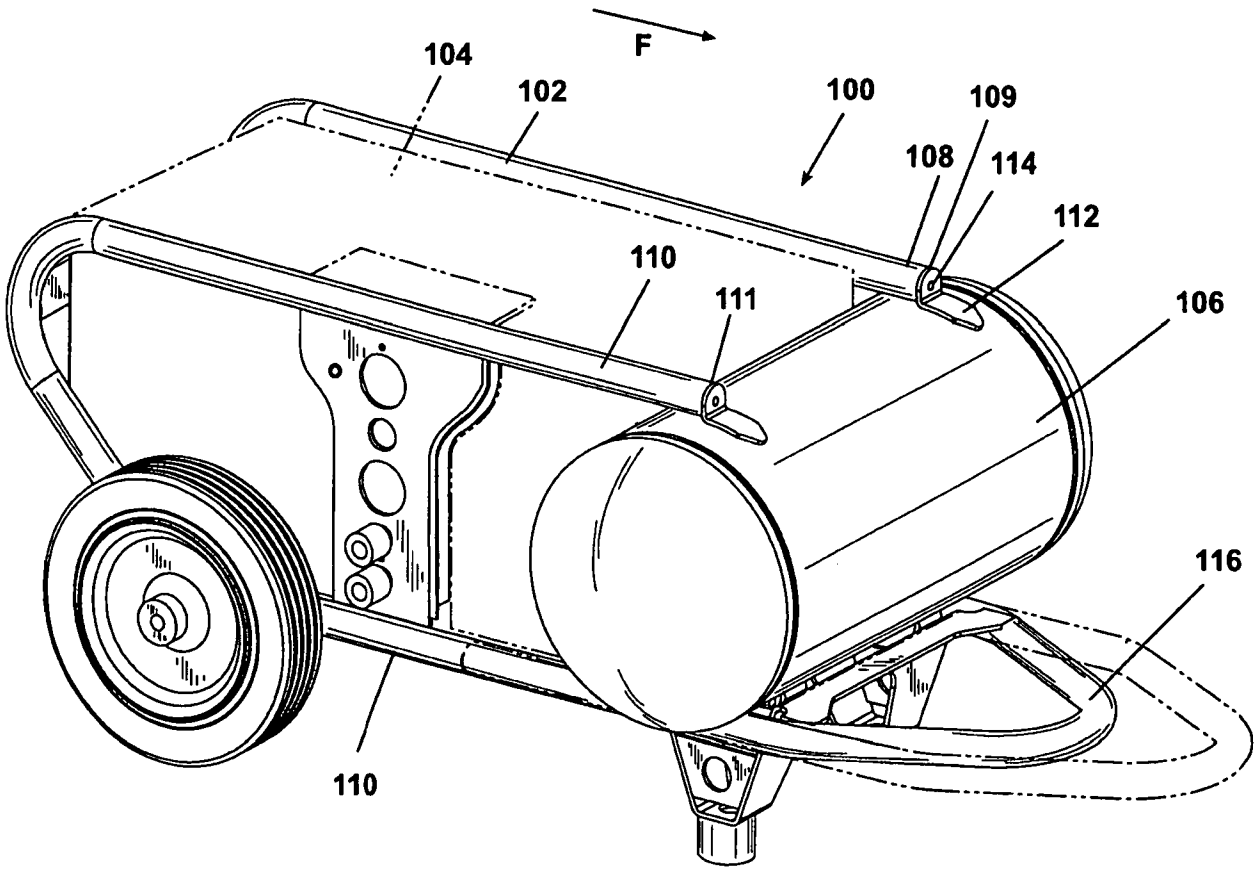
FIG. 10 is a perspective view of another preferred embodiment of the present invention having a frame structurally connected to the fluid pressure tank and a centrally positioned forward support handle.

Referring to FIG. 10, an air compressor assembly 100 for another preferred embodiment of the present invention is shown. The air compressor assembly 100 includes a frame 102, a component group 104, and a fluid pressure tank 106 similar to the air compressor assembly 10. Other components shown including the wheels and the control panel are similar to those shown for air compressor assembly 10 and are therefore not further discussed herein. The frame 102 includes a first side 108 and a second side 110, generally formed of tubular material. Each of the first side 108 and the second side 110 have distal ends 109 and 111, respectively positioned approximately in line with a longitudinal axis of the fluid pressure tank 106 as viewed from a plan view of the air compressor assembly 100. A pair of tabs 112 are joined by each of a pair of fasteners 114 to the first side 108 and the second side 110 on a first end and are welded to the fluid pressure tank 106 on a second end. The frame 102 is therefore connected at both an upper surface and a lower surface of the fluid pressure tank 106 and partially relies on the rigidity of the fluid pressure tank 106 to stiffen the frame 102. The frame 102 also includes a central lift section 116 which is aligned approximately with the assembly longitudinal axis (similar to the assembly longitudinal axis A of the air compressor assembly 10) at a forward end of the air compressor assembly 100. The central lift section 116 permits the air compressor assembly 100 to be pushed or pulled along the air compressor assembly 100 longitudinal axis. Optionally, the central lift section 116 is extended in the forward direction F from a stowed position (shown) to an extended position (shown in phantom) and locked in the extended position. Additionally, the central lift section can be totally removed. Mechanical locking means to lock the central lift section 116 in either of the stowed or the extended positions such as spring loaded pins are known and are therefore not discussed further herein. To make the central lift section 116 extendable, a diameter of the central lift section 116 is made either smaller or larger than the diameter of both the first side 108 and the second side 110.

Figure 11:
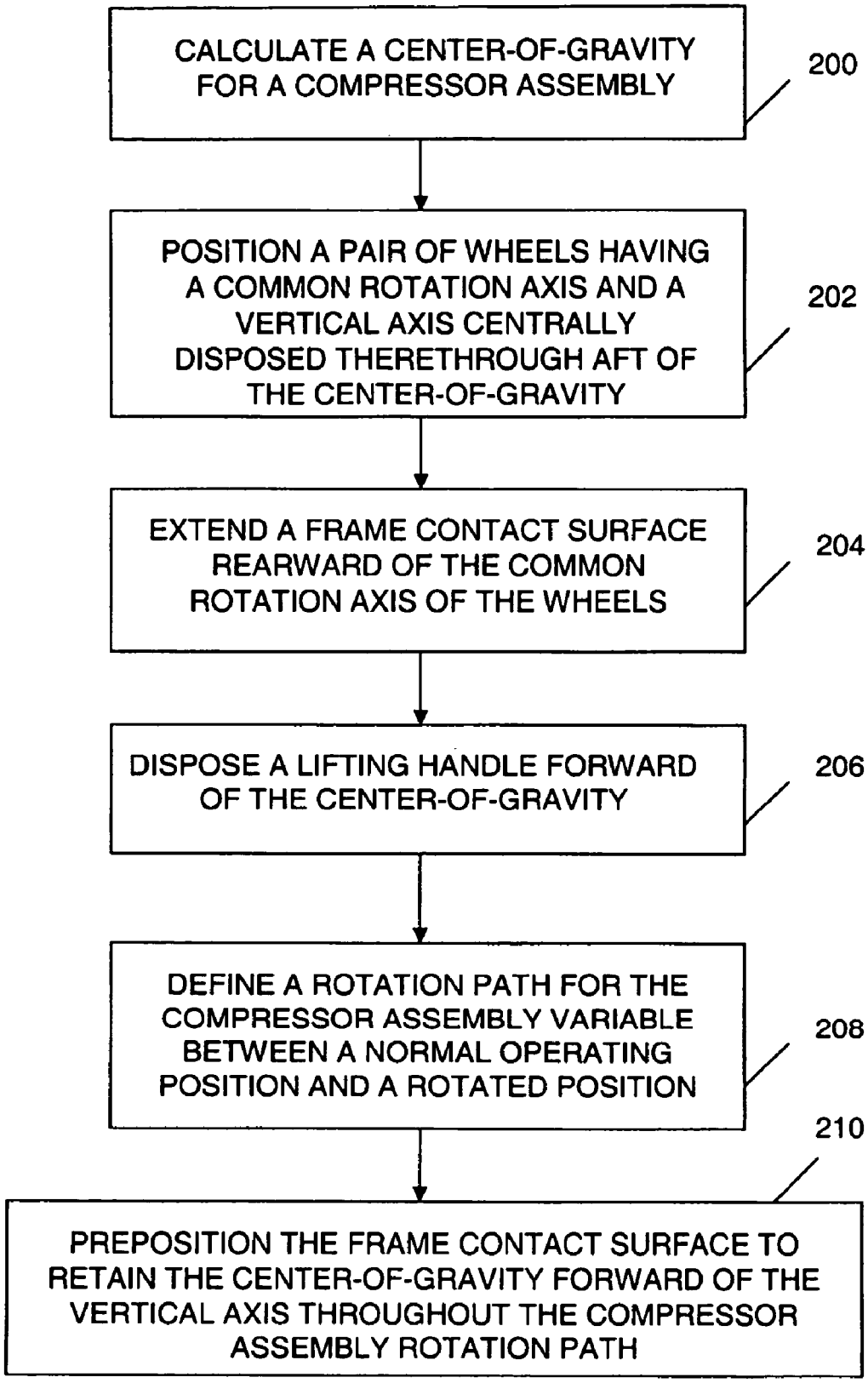
FIG. 11 is a diagrammatic flow chart of the method steps to bias a portable air compressor of the present invention toward a horizontal operating position.

Referring finally to FIG. 11, the method steps to bias a compressor assembly of the present invention are described. In an initial step 200, a center-of-gravity for a compressor assembly is calculated. In a step 202, a pair of wheels having a common axis of rotation and a vertical axis disposed through the common axis of rotation is positioned aft of the center-of-gravity. In a following step 204, a frame contact surface is extended rearward of the common rotation axis of the wheels. In a next step 206, a lifting handle is disposed forward of the center-of-gravity. In step 208, a rotation path for the compressor assembly is defined which varies between a normal operating position and a rotated position, the rotated position having the frame contact surface contacting a ground surface when the lifting handle is used to rotate the compressor assembly about the common axis of rotation. In a final step 210, the frame contact surface is prepositioned to retain the center-of-gravity forward of the vertical axis, throughout the compressor assembly rotation path, to bias the compressor assembly to return by gravity from the rotated position to the normal operating position for any position of the compressor assembly along the rotation path.

An air compressor assembly of the present invention offers several advantages. The rear frame geometry together with selected placement of the center-of-gravity of the unit reduces the likelihood that the air compressor assembly will tip over. A gravity bias returns the unit to the normal operating position. The frame of the air compressor assembly provides a totally enclosed volume to protect the equipment supported by the frame. The control panel of the present invention provides for all of the items mounted thereon to be contained within a planar envelope formed by the ends of the axle supporting the wheels. This reduces the potential to damage any of the components mounted on the control panel. Apertures are provided in the support plate to drain the fluids from the compressor and engine, as well as providing an access for operation of the drain and vent valve from the fluid pressure tank. Multiple support points are available for the different frame embodiments of the present invention to allow the units to be pushed or pulled without tipping over the unit. The small space envelope of the assembly of the present invention permits the entire unit to be placed within standard compartments of commercially available trucks used in the construction industry. The wheels, the support feet, and the forward handle of the air compressor assembly are removable to facilitate a shipping configuration and packaging of the unit.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A portable air compressor assembly, comprising:

a frame having a plurality of members including opposed first and second side sections;

a support plate horizontally disposed between the side sections in a normal operating position of the air compressor assembly;

an axle having opposed ends, the axle rotatably connected to the first and second side sections, and first and second wheels each rotatably connected proximate to one of the opposed ends of the axle;

each side section including:

a first straight portion having the axle extending transversely from the first straight portion;

a first bend located rearward of the axle;

a second straight portion connected to the first bend and oriented in the normal operating position angularly rearwardly and upwardly with respect to the wheel and at an angle with respect to the support plate;

a second bend connected to the second straight portion, the second bend creating a frame rotation stop; and a third straight portion connected to the second bend and oriented substantially parallel to the first straight portion.

2. The assembly of claim 1, wherein the frame further defines an enclosed spatial volume having the support plate connected to the first straight portion.

3. The assembly of claim 2, further comprising a fluid pressure tank releasably connected to both the support plate and the third straight section of each of the side sections, the fluid pressure tank having opposed ends extending beyond the enclosed spatial volume.

4. The assembly of claim 3, further comprising a plurality of operating components connected to the frame proximate a frame rearward end, the operating components defining a combined outer envelope completely contained within the enclosed spatial volume.

5. The assembly of claim 4, wherein the operating components comprise a power unit and a compressor, the power unit operatively connected to the compressor, and the compressor operatively connected to the pressure tank.

6. The assembly of claim 3, further comprising a tab fastenably connected to a distal end of the third straight section and welded to the fluid pressure tank.

7. The assembly of claim 1, further comprising a cross member fixedly connected to the second bend of each of the side sections.

* * * * *

UNITED STATES PATENT AND TRADEMARK OFFICE

CERTIFICATE OF CORRECTION

PATENT NO. : 7,686,591 B2
APPLICATION NO. : 11/355377
DATED : March 30, 2010
INVENTOR(S) : Michael P. Baron et al.

It is certified that error appears in the above-identified patent and that said Letters Patent is hereby corrected as shown below:

Title Page,
Related U.S. Application Data, Insert the following:

--(60) Provisional application No. 60/417,725, filed on Oct. 10, 2002.--

Signed and Sealed this

Thirty-first Day of August, 2010

David J. Kappos

David J. Kappos
*Director of the United States Patent and Trademark Office*